US009253577B2

(12) United States Patent
Fujiwara et al.

(10) Patent No.: US 9,253,577 B2
(45) Date of Patent: Feb. 2, 2016

(54) MULTI-COIL UNIT, VOICE COIL, AND ELECTRO-ACOUSTIC TRANSDUCER USING THE SAME

(71) Applicant: HOSIDEN CORPORATION, Yao-shi, Osaka (JP)

(72) Inventors: Satoru Fujiwara, Yao (JP); Masaaki Miyamoto, Yao (JP); Yoshiyuki Shinoda, Yao (JP)

(73) Assignee: HOSIDEN CORPORATION, Yao-shi (JP)

( * ) Notice: Subject to any disclaimer, the term of this patent is extended or adjusted under 35 U.S.C. 154(b) by 24 days.

(21) Appl. No.: 13/897,642

(22) Filed: May 20, 2013

(65) Prior Publication Data

US 2013/0315434 A1 Nov. 28, 2013

(30) Foreign Application Priority Data

May 23, 2012 (JP) ..... 2012-117855
Mar. 15, 2013 (JP) ..... 2013-053288

(51) Int. Cl.
*H04R 9/04* (2006.01)
*H04R 1/00* (2006.01)

(52) U.S. Cl.
CPC ..... *H04R 9/046* (2013.01); *H04R 1/005* (2013.01); *H04R 9/047* (2013.01); *H04R 2209/024* (2013.01); *H04R 2209/041* (2013.01)

(58) Field of Classification Search
CPC ..... H04R 9/00; H04R 9/02; H04R 9/04; H04R 9/046; H04R 9/047; H04R 9/06; H04R 9/08; H04R 2209/024; H04R 2209/04; H04R 2209/041; H04R 1/005
USPC ..... 381/150, 396, 400, 403, 405–410
See application file for complete search history.

(56) References Cited

U.S. PATENT DOCUMENTS

| | | | | |
|---|---|---|---|---|
| 2,925,541 | A * | 2/1960 | Koch | 381/401 |
| 4,300,022 | A * | 11/1981 | Hastings-James et al. | 381/121 |
| 4,566,120 | A * | 1/1986 | Nieuwendijk et al. | 381/117 |
| 7,729,503 | B2 * | 6/2010 | Young | 381/407 |
| 2004/0136559 | A1 * | 7/2004 | Suzuki | 381/400 |
| 2007/0098189 | A1 * | 5/2007 | Kukurudza | 381/117 |
| 2008/0025551 | A1 * | 1/2008 | Wehner | 381/401 |

FOREIGN PATENT DOCUMENTS

| | | | |
|---|---|---|---|
| DE | 86 04 597.0 | U1 | 6/1987 |
| EP | 2 187 657 | A1 | 5/2010 |
| JP | 60-212100 | | 10/1985 |
| JP | 2010-263332 | A1 | 11/2010 |
| WO | 2009/154067 | A1 | 12/2009 |

OTHER PUBLICATIONS

Extended European Search Report dated Jun. 12, 2014, in the corresponding European patent application No. 13250058.

* cited by examiner

*Primary Examiner* — Ahmad F Matar
*Assistant Examiner* — Sabrina Diaz
(74) *Attorney, Agent, or Firm* — Kratz, Quintos & Hanson, LLP

(57) ABSTRACT

The invention provides a multi-coil unit including first, second, . . . , (n−1)-th, and n-th coil elements corresponding to a number n of quantization bits of a digital signal, the coil elements including coil wires of a same length. The multi-coil unit has a winding structure in which the coil wires are wound a plurality of times to be stacked in a magnetic flux direction to form a plurality of tires.

4 Claims, 3 Drawing Sheets

MULTI-COIL UNIT, VOICE COIL, AND ELECTRO-ACOUSTIC TRANSDUCER USING THE SAME

CROSS-REFERENCE TO RELATED APPLICATIONS

The present application claims priority under 35 U.S.C. §119 of Japanese Patent Application Nos. 2012-117855 filed on May 23, 2012 and 2013-053288 filed on Mar. 15, 2013, the disclosure of which is expressly incorporated by reference herein in its entity.

BACKGROUND OF THE INVENTION

1. Technical Field

The invention relates to multi-coil units, voice coils, and electro-acoustic transducers that are applicable to digital speakers and other apparatuses.

2. Background Art

Developments have been made on digital speakers that directly receive and reproduce digital audio signals, instead of converting digital signals into analog. A known digital speaker of this type has a plurality of coils wound around a voice coil bobbin. The coils are weighted in such a manner to generate respective driving forces corresponding to respective bits of a digital signal. Each coil carries a predetermined voltage, the polarity of which is switched in accordance with a 2-bit binary value of a digital signal, thereby determining the direction of current flowing through the coil in accordance with the binary value. This configuration allows the digital speaker to generate driving forces at a ratio corresponding to the quantization of a digital signal (see Japanese Unexamined Patent Application Publication No. 2010-263332 A).

Such a digital speaker may have a voice coil configured as shown in FIG. 5. The reference numeral 13 in FIG. 5 denotes a voice coil, 1 denotes a yoke, 2 denotes a magnet, 3 denotes a pole piece, and G denotes a magnetic gap. The voice coil 13 includes a coil 13A, a coil 13B, and a coil 13C in accordance with the number of quantization bits of a digital signal. The coil 13A has a winding structure in which a coil wire is wound a plurality of times in a coil vibration direction ($\alpha$ in FIG. 5) to be stacked (in two tiers in the example of FIG. 5) in a magnetic flux direction ($\beta$ in FIG. 5). The same holds true for the coil 13B and the coil 13C. The coil 13B is wound on the outer periphery of the coil 13C, and the coil 13A is wound on the outer periphery of the coil 13B.

SUMMARY OF INVENTION

In the voice coil 13, the wound coils 13A, 13B, and 13C have different radial dimensions from each other, i.e. the coil wires of these coils have different overall lengths from each other. This causes variations in electrical characteristics (direct-current resistance, impedance, etc.) among the coils 13A, 13B, and 13C. As a result, the voice coil 13 cannot produce driving forces at a ratio in accordance with quantization of a digital signal (nonlinearity occurs), making it difficult to provide desired audio characteristics. Desired audio characteristics may be obtained if the nonlinearity is rectified by some means, but such rectification will obviously result in an increased cost of the digital speaker.

FIG. 6 illustrates another known voice coil 13', wherein coils 13A', 13B', and 13C' are arranged in this order, not in a direction $\beta$ but in a vibration direction $\alpha$. This case appears to be free from the problem described above at first glance because the coil wires of the coils 13A', the coil 13B', and the coil 13C' have the same overall lengths. However, the voice coil 13' cannot provide desired audio characteristics either for the following reasons. The coil 13A', the coil 13B', and the coil 13C' are at different relative positions with respect to the magnet 2 and at different distances from the magnet 2 on the magnetic circuit. This arrangement produces a nonuniform magnetic flux distribution in the magnetic gap G, making it impossible to produce driving forces at a ratio in accordance with quantization of a digital signal. In short, it is realistically difficult for conventional voice coils to pursue both improved performance in audio characteristics and reduced costs.

The invention has been made in view of the problems described above. The invention provides a multi-coil unit, a voice coil, and an electro-acoustic transducer that improved performance in audio characteristics and reduced costs can be both pursued with a simple configuration.

A multi-coil unit according to an aspect of the invention includes first, second, . . . , (n−1)-th, and n-th coil elements corresponding to a number n of quantization bits of a digital signal, the coil elements including coil wires of a same length. The multi-coil unit has a winding structure in which the coil wires are wound a plurality of times to be stacked in a magnetic flux direction to form a plurality of tiers.

In the multi-coil unit of this aspect, the coil wires of the first, second, . . . , (n−1)-th, n-th coil elements have the same overall lengths, causing no variations in electrical characteristics (direct-current resistance, impedance, etc.). Further, the first, second, . . . , (n−1)-th, n-th coil elements have substantially the same positional or distance relationships with respect to a magnetic circuit. It is therefore possible, unlike the conventional cases, to generate driving forces at a ration in accordance with quantization of a digital signal without correcting the above-mentioned nonlinearity and to obtain desired audio characteristics. In short, it is possible to pursue both improved performance in audio characteristics and reduced cost with the claimed multi-coil unit.

The coil elements may each include portions of the associated coil wire in the respective tiers. The portions of the coil wire may be arrayed in a separate line in the magnetic flux direction from the portions of any other one of the coil wires.

The coil elements may be fixed next to one another. Preferably, the coil elements may be fixed to one another to be arrayed in a line along a coil vibration direction of the multi-coil unit.

The multi-coil unit described above, the claimed arrangement of the first, second, . . . , (n−1)-th, n-th coil elements causes no variance in the driving forces generated at the coil elements, resulting in an improved linearity that provides more desirable audio characteristics.

The coil wires of the coil elements in an unwound state may be arrayed in a line along a coil vibration direction of the multi-coil unit. The winding structure of the multi-coil unit may be formed such that the coil wires are wound to be stacked in the coil vibration direction and also stacked in the magnetic flux direction. The winding structure may include a plurality of types of first coil portions of different outer diameters and a plurality of types of second coil portions of different outer diameters. The first coil portions and the second coil portions may be arranged alternately and concentrically in the magnetic flux direction. The first coil portions may be formed such that first parts of the coil wires are wound toward one end in the coil vibration direction in tuboid form to form a plurality of tiers. The tiers of the first coil portions may include end tiers at the one end in the coil vibration direction and end tiers at the other end in the coil vibration direction. The second coil portions may be formed such that second parts of the coil wires are wound toward the other end in the coil vibration direction in tuboid form to form a plurality of tiers. The tiers of the second coil portions may include end tiers at the one end in the coil vibration direction and end tiers at the other end in the coil vibration direction. First portions of the coil wires forming the end tiers at the one end of the first coil portions may be continuous with second portions of the coil wires forming the end tiers at the one end of the second coil portions immediately external to the first coil portions. Third portions of the coil wires forming the end tiers at the other end of the second coil portions may be continuous with fourth portions of the coil wires forming the end tiers at the other end of the first coil portions immediately external to the second coil portions. In the multi-coil unit of this aspect, portions of the first and second coil portions constituting the respective tiers (portions of the coil wires) have substantially the same positional or distance relationships with respect to a magnetic circuit.

A voice coil in accordance with the invention may include a multi-coil unit in accordance with any of the above aspects and a guide to receive therethrough the coil elements of the multi-coil unit. The voice coil in this configuration makes it possible to determine the positional relationship of the first, second, . . . , (n−1)-th, n-th coil elements by performing a winding work just once for the multi-coil unit. The winding work is thus simplified compared to the conventional cases where the coils are wound separately. The costs can be reduced accordingly.

An electro-acoustic transducer in accordance with the invention includes a magnetic circuit including a magnetic gap, a voice coil accommodated in the magnetic gap, the voice coil including the multi-coil unit in accordance with any of the above aspects, a diaphragm coupled to the voice coil, and a frame holding the diaphragm and the magnetic circuit.

DESCRIPTION OF EMBODIMENTS

Figure 1:
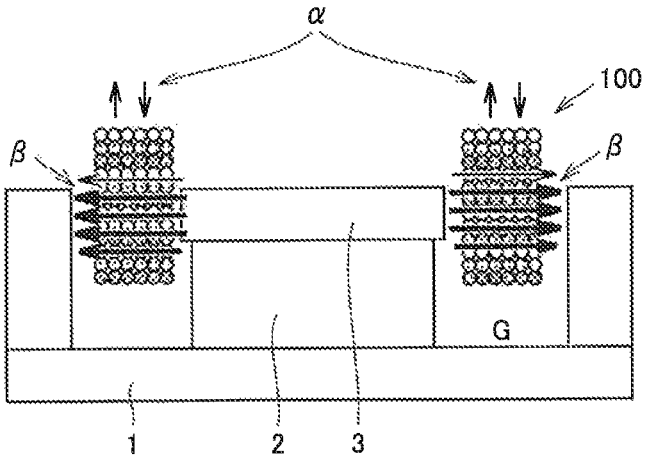
FIG. 1 is a schematic vertical cross-sectional view of an electro-acoustic transducer in accordance with an embodiment of the invention, focusing on a voice coil of the transducer.
Figure 2:
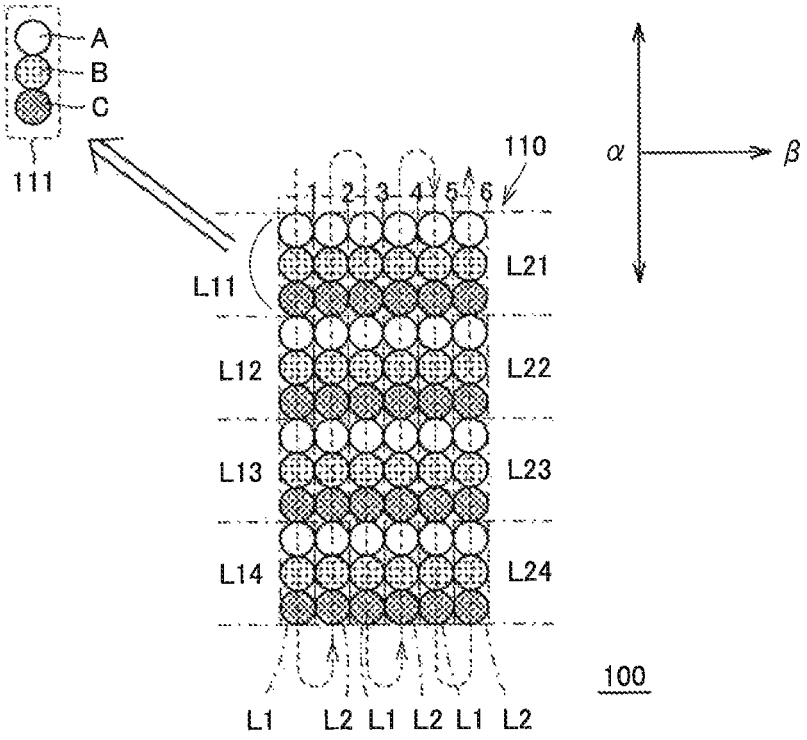
FIG. 2 is a cross-sectional view of the voice coil and also of a multi-coil unit forming part of the voice coil.
Figure 3:
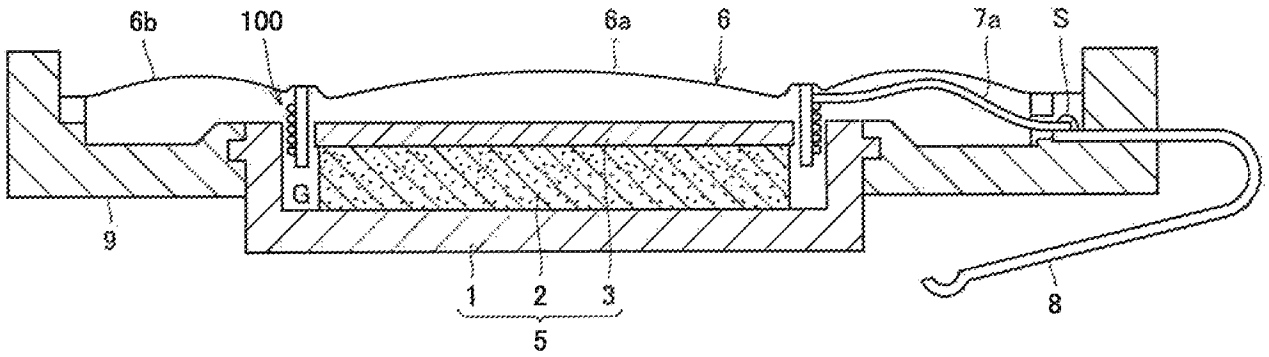
FIG. 3 is a vertical cross-sectional view of a digital speaker serving as the electro-acoustic transducer.

The following describes a voice coil 100 in accordance with an embodiment of the invention with reference to FIGS. 1 and 2. The voice coil 100 shown in FIGS. 1 and 2 is a tubular coil that may be used in a digital speaker (an electro-acoustic transducer) as shown in FIG. 3. The voice coil 100 includes a multi-coil unit 110 and a guide 111. The multi-coil unit 110 consists of a coil element A, a coil element B, and a coil element C (corresponding to first, second, and third coil elements) corresponding to the number n of quantization bits of a digital audio signal (n=3 in the present embodiment). The multi-coil unit 110 has a winding structure in which the multi-coil unit is wound a plurality of times (four times in the embodiment as shown in FIG. 2) in a coil vibration direction α (see FIGS. 1 and 2) to form tiers (six tiers in the embodiment as shown in FIG. 2) in a magnetic flux direction β (see FIGS. 1 and 2). More particularly, the multi-coil unit 110 consist of tiers of the coil element A, tiers of the coil element B, and tiers of the coil element C are arrayed in separate lines in the magnetic flux direction β of a magnetic circuit 5 (to be described). It will be appreciated that the coil vibration direction α corresponds to the axial direction of the multi-coil unit 110, and the magnetic flux direction β corresponds to the radial direction of the multi-coil unit 110. Also, the coil element B and the coil element C are illustrated with halftone dots in FIGS. 1 and 2 for the sake of distinction between the coil element A, the coil element B, and the coil element C, and the halftone dots do not indicate any differences in the cross sections or any differences in the materials of the coil element A, the coil element B, and the coil element C.

As shown in FIG. 2, the coil element A, the coil element B, and the coil element C are inserted through the guide 111 and fixed next to one another. The coil element A, the coil element B, and the coil element C are coil wires of the same length having welding tiers. The coil wires of the coil element A, the coil element B, and the coil element C are stacked in the coil vibration direction α (i.e., they are arrayed in the coil vibration direction α). The coil wires adjacent in the coil vibration direction α are fixed to each other. In the present embodiment, the coil wire of the coil element A and the coil wire of the coil element B are fixed to each other, and the coil wire of the coil element B and the coil wire of the coil element C are fixed to each other. The winding structure of the multi-coil unit 110 is such that the fixed coil wires are wound so as to be stacked in the coil vibration direction α and also in the magnetic flux direction β. Specifically, the winding structure of the multi-coil unit 110 has tuboid first and second coil portions L1 and L2 of a plurality of types, i.e. of different outer diameters. The first and second coil portions L1 and L2 are alternately and concentrically arranged in the magnetic flux direction β. The first and second coil portions L1 and L2 that are adjacent in the magnetic flux direction β are in contact with each other.

The first coil portions L1 have the same structure except for their outer diameters. The first coil portions L1, except the innermost one, each have an inner diameter slightly larger than the outer diameter of the second coil portion L2 located immediately internal to the each first coil portion L1. The first coil portions L1 are each configured such that a part of the fixed coil wires (first parts of the coil wires) is wound to one side in the coil vibration direction α so as to form a tuboid shape in a plurality of tiers (in four tiers, i.e. tiers L11 to L14 in FIG. 2). Of the tiers L11 to L14 of each first coil portion L1, the tiers adjacent in the coil vibration direction α are in contact with each other. In the present embodiment, the tier L11 and the tier L12 are in contact with each other, the tier L12 and the tier L13 are in contact with each other, and the tier L13 and the tier L14 are in contact with each other.

The second coil portions L2 have the same structure except for their outer diameters. The second coil portions L2 each have an inner diameter slightly larger than the outer diameter of the first coil portion L1 located immediately internal to the each second coil portion L2. The second coil portions L2 are each configured such that a part of the fixed coil wires (second parts of the coil wires), which is a different part from the one for each first coil portion L1, is wound to the other side in the coil vibration direction α so as to form a tuboid shape in a plurality of tiers (in four tiers, i.e. tiers L24 to L21 in FIG. 2).

Of the tiers L24 to L21 of each second coil portion L2, the tiers adjacent in the coil vibration direction α are in contact with each other. In the present embodiment, the tier L24 and the tier L23 are in contact with each other, the tier L23 and the tier L22 are in contact with each other, and the tier L22 and the tier L21 are in contact with each other.

In each of the first coil portions L1, a portion of the fixed coil wires (first portions of the coil wires) forming an end tier on the one side in the coil vibration direction α (the lowest tier) is continuous with another portion of the fixed coil wires (second portions of the coil wires) forming an end tier on the one side in the coil vibration direction α (the lowest tier) of the second coil portion L2 located immediately external to the first coil portion L1. In each of the second coil portions L2, a portion of the fixed coil wires (third portions of the coil wires) forming an end tier on the other side in the coil vibration direction α (the highest tier) is continuous with another portion of the fixed coil wires (fourth portions of the coil wires) forming an end tier on the other side in the coil vibration direction α (the highest tier) of the first coil portion L1 located immediately external to the second coil portion L2.

As will be described in full detail in the case of the present embodiment, in the first coil portion L1 in the first layer (the innermost layer), a portion of the fixed coil wires (first portions of the coil wires) forming the tier L14 is continuous with another portion of the fixed coil wires (second portions of the coil wires) forming the tier L24 of the second coil portion L2 in the second layer located immediately external to this first coil portion L1. In the second coil portion L2 of the second layer, a portion of the fixed coil wires (third portions of the coil wires) forming the tier L21 is continuous with another portion of the fixed coil wires (fourth portions of the coil wires) forming the tier L11 of the first coil portion L1 in the third layer located immediately external to this second coil portion L2. In the first coil portion L1 in the third layer, a portion of the fixed coil wires (first portions of the coil wires) forming the tier L14 is continuous with another portion of the fixed coil wires (second portions of the coil wires) forming the tier L24 of the second coil portion L2 in the fourth layer located immediately external to this first coil portion L1. In the second coil portion L2 in the fourth layer, a portion of the fixed coil wires (third portions of the coil wires) forming the tier L21 of is continuous with another portion of the fixed coil wires (fourth portions of the coil wires) forming the tier L11 of the first coil portion L1 in the fifth layer located immediately external to this second coil portion L2. In the first coil portion L1 in the fifth layer, a portion of the fixed coil wires (first portions of the coil wires) forming the tier L14 is continuous with another portion of the fixed coil wires (second portions of the coil wires) forming the tier L24 of the second coil portion L2 in the sixth layer located immediately external to the first coil portion L1.

The portions of the coil wires (the coil elements A, B, and C) forming the tiers L11, L21 are stacked and arrayed in the magnetic flux direction β. The portions of the coil wires (the coil elements A, B, and C) forming the tiers L12, L22 are stacked and arrayed in the magnetic flux direction β. The portions of the coil wires (the coil elements A, B, and C) forming the tiers L13, L23 are stacked and arrayed in the magnetic flux direction β. The portions of the coil wires (the coil elements A, B, and C) forming the tiers L14, L24 are stacked and arrayed in the magnetic flux direction β.

The voice coil 100 as described above may be fabricated in the following steps. The first step is to prepare three straight coil wires (i.e., the coil element A, the coil element B, and the coil element C) of the same length. The coil wires are stacked in a line in the coil vibration direction α such that adjacent coil wires are in contact with each other. Then, the coil wires are inserted through the guide 111 and heated in this state from the outside of the guide 111, and the adjacent coil wires are fixed to each other by thermal welding. The coil wires adjacent in the coil vibration direction α are thus fixed to each other. Then, the fixed coil wires are wound and stacked in a manner as shown with the dotted arrows in FIG. 2 to form the tiers. More specifically, a part of the fixed coil wires (first parts of the coil wires) is wound to the one side in the coil vibration direction α to form the tiers L11 to L14. At this point the tiers L11 to L14 adjacent to one another in the coil vibration direction α are brought into contact with one another. The stacked tiers L11 to L14 form the innermost one of the first coil portions L1. The next step is to wind another part of the fixed coil wires (second parts of the coil wires) that is continuous with the aforementioned part to the other side in the coil vibration direction α to form the tiers L24 to L21 outside the first coil portion L1. At this point the tiers L24 to L21 adjacent to one another in the coil vibration direction α are brought into contact with one another, and they are in contact with the tiers L14 to L11, respectively, of the first coil portion L1. The stacked tiers L24 to L21 form one of the second coil portions L2 concentrically disposed outside the first coil portion L1. The next step is to wind another part of the fixed coil wires (first parts of the coil wires) that is continuous with the aforementioned another part to the one side in the coil vibration direction α to form another set of tiers L11 to L14 outside the second coil portion L2. At this point the tiers L11 to L14 adjacent to one another in the coil vibration direction α are brought into contact with one another, and they are in contact with the tiers L21 to L24, respectively, of the second coil portion L2. The stacked tiers L11 to L14 form another first coil portion L1 concentrically disposed outside the second coil portion L2. Then, the fabrication steps of another second coil portion L2 and another first coil portion L1 are alternately repeated. This is how to fabricate the voice coil 100.

FIG. 3 shows an electro-acoustic transducer, which is a digital speaker that may be applicable to mobile phones and many other uses. This electro-acoustic transducer includes a magnetic circuit 5 with a magnetic gap G, the voice coil 100 to be contained in the magnetic gap G, a diaphragm 6 coupled to the voice coil 100, and a frame 9 for holding the diaphragm 6 and the magnetic circuit 5.

The magnetic circuit 5 includes a yoke 1, a magnet 2, a pole piece 3, and the magnetic gap G. The yoke 1 is made of magnetic material. The yoke 1 includes a bottom portion and a tuboid side wall provided on the upper face of the bottom portion. The magnet 2 of columnar shape is fixed on the upper face of the bottom portion of the yoke 1. The pole piece 3 is a magnetic plate fixed on the upper surface of the magnet 2. The magnetic gap G is formed between the pole piece 3 and the side wall of the yoke 1. The voice coil 100 is inserted into the magnetic gap G in a vertically movable manner (movable in the coil vibration direction α). In the present embodiment, a magnetic flux flows from the pole piece 3 to the side wall of the yoke 1 (in the magnetic flux direction β of the magnetic circuit 5), and the magnetic flux passes through the voice coil 100 received in the magnetic gap G.

The diaphragm 6 may be made of a resin or metal film. The diaphragm 6 includes a center dome 6*a* swelling upward and an annular edge 6*b*, which is integrally provided with the peripheral edge of the center dome 6*a*. The voice coil 100 is fixed on the back side of the boundary between the center dome 6*a* and the edge 6*b* of the diaphragm 6. The combination of the diaphragm 6 and the voice coil 100 constitutes a vibration system of the electro-acoustic transducer.

The frame 9 is an annular insulating member to hold the yoke 1 and the diaphragm 6 at its center. The peripheral edge of the frame 9 is fixedly provided with a total of three input terminals 8 (one of them is shown in the figure) for inputting digital audio signals. The input terminals 8 are connected, by means of soldering S, to lead wires 7*a* (one is shown in the figure) that are led out from the respective ends of the coil element A, the coil element B, and the coil element C of the voice coil 100.

The electro-acoustic transducer configured as described may produce sound in the following manner. When a digital audio signal is input from an external circuit to the voice coil 100 via the input terminals 8, an electromagnetic action between the voice coil 100 and the magnetic field inside the magnetic gap G causes the voice coil 100 to vibrate in the vibration direction α (the vertical direction in FIG. 1). The diaphragm 6 accordingly vibrates vertically to produce sound.

It is possible to drive the voice coil 100 with either of digital audio signals and analog audio signals by providing a selector switch (not shown) upstream from the input terminals 8. For analog reproduction, the coil element A, the coil element B, and the coil element C may be connected in parallel by switching the contact points of the switch. Also, in the case of driving the voice coil 100 only with analog audio signals, the coil element A, the coil element B, and the coil element C of the voice coil 100 may be connected in parallel and twisted together. Twisted coil wires should lead to increased strength of the coils themselves.

The voice coil 100 used in the electro-acoustic transducer configured as described above has the following advantageous technical features. a) The coil wires of the coil element A, the coil element B, and the coil element C have the same overall lengths, causing no variations in electrical characteristics (direct-current resistance, impedance, etc.) between the coil elements. b) the portions of the coil wires (the coil elements A, B, and C) constituting the tiers L11 to L14 and the tiers L21 to L24 have substantially the same positional or distance relationships with respect to the magnet 2 of the magnetic circuit 5. c) As the portions of the coil wires (the coil elements A, B, and C) constituting the tiers L11 to L14 and the tiers L21 to L24 are arranged as described in feature (b), there is no variance in the driving forces generated at the coil elements. Therefore, driving forces are generated at a ratio in accordance with the quantization of a digital signal, so that the voice coil 100 can provide desirable audio characteristics. There is no need to correct the non linearity between a digital signal and generated driving forces with the voice coil 100, making it possible to pursue both improved efficiency in audio characteristics and reduced cost. d) Also, it is possible to determine the positional relationship of the coil element A, the coil element B, and the coil element C by performing a winding work just once for the multi-coil unit 110. The winding work of the voice coil 100 is thus simplified compared to the conventional cases where the coils are wound separately. It is thus possible to further purse cost reduction.

Figure 4A:
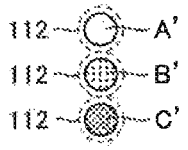
FIG. 4A is a schematic cross-sectional view of a first design modification of the multi-coil unit of the embodiment.
Figure 4B:
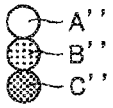
FIG. 4B is a schematic cross-sectional view of a second modification of the multi-coil unit of the embodiment.
Figure 4C:
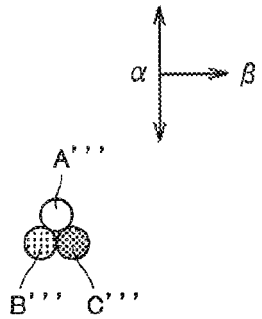
FIG.4C PRIOR ART
FIG. 4C is a schematic cross-sectional view of a third modification of the multi-coil unit of the embodiment.
Figure 5:
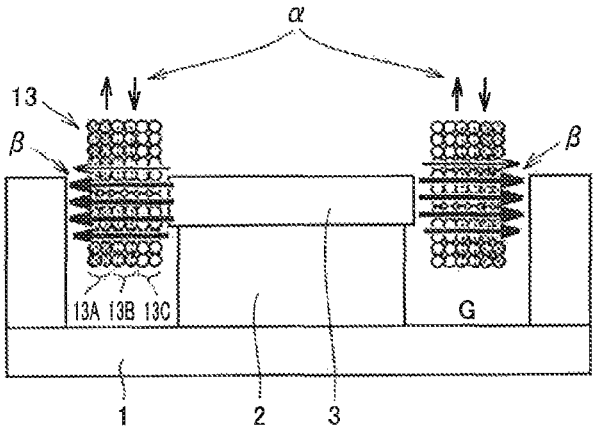
FIG.5 PRIOR ART
FIG. 5 is a view, corresponding to FIG. 1, of a conventional voice coil.
Figure 6:
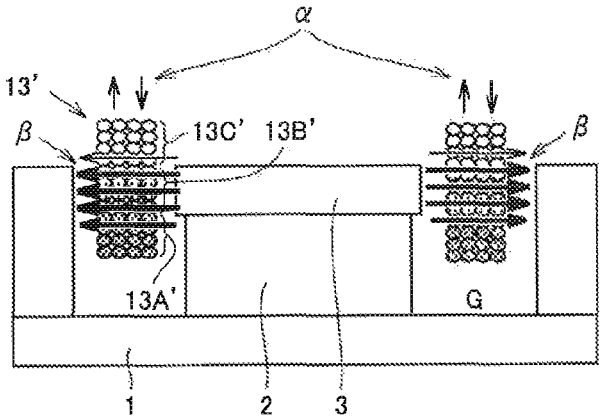
FIG. 6 is a view, corresponding to FIG. 1, of another conventional voice coil.

The following describes first to third modification examples (where n=3) of the multi-coil unit 110 referring to FIGS. 4A to 4C, focusing mainly on the differences from the embodiment described above. The first modification example as shown in FIG. 4A is a case where the guide 113 is not used. Coil elements A', B', and C' each have a coating 112 to coat the coil wire, and the coil wires are aligned in a line in the vibration direction α. The adjacent coatings 112 of the coil elements A', B', and C' in the vibration direction α are fixed to one another by a known conventional method. FIG. 4B illustrates the second modification example, in which case the guide 111 is not used and coil elements A", B", and C" are not coated (that is, they have the coil wires only). The coil wires of the coil elements A", B", and C" are aligned in a line in the vibration direction α, and the adjacent coil wires in the vibration direction α are fixed to one another by a known conventional method.

The third modification example has a modified arrangement of the coil elements, in which case coil elements A'", B'", and C'" has a triangular arrangement as shown in FIG. 4C. The coil elements A'", B'", and C'" include coil wires of the same length that are wound so as to be stacked in the coil vibration direction α and also in the magnetic flux direction β in a similar manner as in the above embodiment.

It should be appreciated that the voice coil of the invention is not limited to the embodiment described above but may be applicable not only to digital speakers, but also to microphones, headphones, earphones or the like. In other words, the electro-acoustic transducer of the invention may be applicable to microphones, headphones, earphones or the like. Also, the multi-coil unit of the invention may be modified in any manner if it includes a plurality of coil elements, i.e. the number corresponding to the number of quantization bits of a digital signal and has a winding structure having a plurality of turns to form tiers in the magnetic flux direction. In other words, the multi-coil unit of the invention may have any number of turns and any number of tiers by any winding method.

For example, the multi-coil unit of the invention may include a corresponding number of coil wires to the number of quantization bits of a digital signal. The coil wires may be of the same length, and in an unwound state they may be arrayed in a line in the axial direction of the multi-coil unit or arranged to have a generally triangular shape in cross-section. The multi-coil unit may have a winding structure in which the arrayed coil wires are wound to be stacked in the magnetic flux direction of a magnetic circuit, or a winding structure in which the arrayed coil wires are wound to be stacked in the axial direction also stacked in the magnetic flux direction. The winding structure of the multi-coil unit may include a plurality of types of first coil portions of different outer diameters and a plurality of types of second coil portions of different outer diameters. The first coil portions and the second coil portions may be arranged alternately and concentrically in the magnetic flux direction. The first and second coil portions may be in contact with each other in the magnetic flux direction. The first coil portions may be formed such that first parts of the coil wires are wound toward one end in the coil vibration direction in tuboid form to form a plurality of tiers. The tiers of the first coil portions may include end tiers at the one end in the coil vibration direction and end tiers at the other end in the coil vibration direction. The adjacent tiers of each first coil portion in the axial direction may be in contact with each other. The second coil portions may be formed such that second parts of the coil wires are wound toward the other end in the coil vibration direction in tuboid form to form a plurality of tiers. The tiers of the second coil portions may include end tiers at the one end in the coil vibration direction and end tiers at the other end in the coil vibration direction. The adjacent tiers of each second coil portion in the axial direction may be in contact with each other. First portions of the coil wires forming the end tiers at the one end of the first coil portions may be continuous with second portions of the coil wires forming the end tiers at the one end of the second coil portions immediately external to the first coil portions. Third portions of the coil wires forming the end tiers at the other end of the second coil portions may be continuous with fourth portions of the coil wires forming the end tiers at the other end of the first coil portions immediately external to the second coil portions. Additionally, at least one tier will suffice for each of the first and second coil portions.

REFERENCE SIGNS LIST

100 Voice coil
110 Multi-coil unit
A, B, C Coil element
111 Guide
α Coil vibration direction (axial direction of multi-coil unit)
β Magnetic flux direction (radial direction of multi-coil unit)

The invention claimed is:

1. A voice coil comprising:

first, second, . . . . (n−1)-th, and n-th coil wires of a same length, the number n corresponding to a number n of quantization bits of a digital signal, the coil wires in an unwound state being arranged in a line along an axial direction of the voice coil; and a guide receiving therethrough the coil wires in an unwound state and as arrayed in a line along the axial direction, wherein the voice coil has a winding structure in which the guide and the coil wires received therethrough are wound to be stacked in the axial direction and also stacked in a radial direction of the voice coil, the winding structure including a plurality of types of first coil portions of different outer diameters and a plurality of types of second coil portions of different outer diameters, the first coil portions and the second coil portions being arranged alternately and concentrically in the radial direction, the first coil portions are formed such that first parts of the coil wires are wound toward one end in the axial direction in tuboid form to form a plurality of tiers, the tiers of the first coil portions including end tiers at the one end in the axial direction and end tiers at the other end in the axial direction, the second coil portions are formed such that second parts of the coil wires are wound toward the other end in the axial direction in tuboid form to form a plurality of tiers, the tiers of the second coil portions including end tiers at the one end in the axial direction and end tiers at the other end in the axial direction, first portions of the coil wires forming the end tiers at the one end of the first coil portions are continuous with second portions of the coil wires forming the end tiers at the one end of the second coil portions immediately external to the first coil portions, and third portions of the coil wires forming the end tiers at the other end of the second coil portions are continuous with fourth portions of the coil wires forming the end tiers at the other end of the first coil portions immediately external to the second coil portions.

2. An electro-acoustic transducer comprising:

a magnetic circuit including a magnetic gap;

a voice coil accommodated in the magnetic gap, the voice coil in accordance with claim 1;

a diaphragm coupled to the voice coil; and a frame holding the diaphragm and the magnetic circuit.

3. The voice coil in accordance with claim 1, wherein immediately external to the end tier at the one end of each of the first coil portions exists the end tier at the one end of an adjacent one of the second coil portions, immediately external to the end tier at the other end of each of the first coil portions exists the end tier at the other end of an adjacent one of the second coil portions, immediately external to the end tier at the one end of each of the second coil portions except the outermost second coil portion exists the end tier at the one end of an adjacent one of the first coil portions, and immediately external to the end tier at the other end of each of the second coil portions except the outermost second coil portion exists the end tier at the other end of an adjacent one of the first coil portions.

4. A multi-coil unit comprising three or more coil wires of equal length corresponding to a number of quantization bits of a digital signal, the number being three or more, the coil wires in an unwound state being arrayed in a line along an axial direction of the multi-coil unit, wherein the multi-coil unit has a winding structure in which the coil wires are wound to be stacked in the axial direction and also stacked in the radial direction, the winding structure including a plurality of types of first coil portions of different outer diameters and a plurality of types of second coil portions of different outer diameters, the first coil portions and the second portions being arranged alternately and concentrically in the radial direction, the first coil portions are formed such that first parts of the coil wires are wound toward one end in the axial direction in tuboid form to form a plurality of tiers, the tiers of the first coil portions including end tiers at the one end in the axial direction and end tiers at the other end in the axial direction, the second coil portions are formed such that second parts of the coil wires are wound toward the other end in the axial direction in tuboid form to form a plurality of tiers, the tiers of the second coil portions including end tiers at the one end in the axial direction and end tiers at the other end in the axial direction, first portions of the coil wires forming the end tiers at the one end of the first coil portions are continuous with second portions of the coil wires forming the end tiers at the one end of the second coil portions immediately external to the first coil portions, and third portion of the coil wires forming the end tiers at the other end of the second coil portions are continuous with fourth portions of the coil wires forming the end tiers at the other end of the first coil portions immediately external to the second coil portions.

* * * * *